US007286445B2

(12) United States Patent
Terzian et al.

(10) Patent No.: US 7,286,445 B2
(45) Date of Patent: Oct. 23, 2007

(54) UNIFIED DIGITAL TIME DISPLAYS

(75) Inventors: Berj A. Terzian, Newbury, MA (US); Michael Terzian, Croton-on-Hudson, NY (US)

(73) Assignee: Equitime, Inc., Newbury, MA (US)

( * ) Notice: Subject to any disclaimer, the term of this patent is extended or adjusted under 35 U.S.C. 154(b) by 141 days.

(21) Appl. No.: 10/995,445

(22) Filed: Nov. 23, 2004

(65) Prior Publication Data

US 2006/0109749 A1 May 25, 2006

(51) Int. Cl.
*G04C 19/00* (2006.01)

(52) U.S. Cl. ..... 368/82; 368/239

(58) Field of Classification Search ..... 368/241, 368/242, 239, 82–84, 107–113, 240, 223
See application file for complete search history.

(56) References Cited

U.S. PATENT DOCUMENTS 4,194,352 A 3/1980 Terzian
4,264,966 A * 4/1981 Terzian ..... 368/82
4,270,196 A 5/1981 Terzian
4,271,497 A 6/1981 Terzian
4,483,628 A * 11/1984 Terzian ..... 368/82
4,627,737 A 12/1986 Nance et al.
4,671,673 A 6/1987 Terzian
4,720,823 A 1/1988 Terzian
5,182,733 A 1/1993 Terzian
5,757,730 A * 5/1998 Terzian ..... 368/82
5,805,534 A * 9/1998 Terzian ..... 368/241
6,215,736 B1 4/2001 Terzian
6,286,991 B1 9/2001 Terzian
6,386,754 B2 5/2002 Terzian
6,418,085 B2 7/2002 Terzian
6,493,209 B1 12/2002 Terzian
6,493,290 B1 * 12/2002 Terzian ..... 368/82
6,545,952 B1 4/2003 Terzian
6,563,764 B2 5/2003 Terzian
6,584,041 B1 6/2003 Terzian et al.
6,807,130 B2 10/2004 Terzian
6,816,441 B2 11/2004 Terzian

* cited by examiner

*Primary Examiner*—Ren Yan
(74) *Attorney, Agent, or Firm*—Lucas & Mercanti, LLP

(57) ABSTRACT

A unified digital time display is presented in an expanded display field and configured for compatibility with prior balanced, quadribalanced, enhanced quadribalanced or unidirectional segmented displays by positioning hour display elements generally in the center of the field, minute display elements in a space beside the right flank of the hour elements, seconds display elements below the hour elements, with markers in a space beside the left flank of the hour elements which are visually different and distinguishable from markers included in the prior displays. These time elements are preferably activated to display solely elapsed time in a timepiece which also includes, preferably, balanced, quadribalanced, enhanced quadribalanced and unidirectional segmented time displays, and enables alternately switching between the three types of displays, with each preceded by a respective ER, ES and EU prompt to identify the type of time display that is provided in a preferred order of presentation represented by such prompts.

16 Claims, 1 Drawing Sheet

UNIFIED DIGITAL TIME DISPLAYS

BACKGROUND OF THE INVENTION

1. Field of the Invention

This invention relates to digital time displays and, more particularly, to displays which are unified and structured to occupy expanded fields which provides advantages when used as such or in combination with other displays having similar characteristics.

2. Description of the Prior Art

Conventional digital time displays generally consist of hour, minutes and sometimes seconds digits aligned horizontally across a display field in that order. Other information such as a day name and/or calendar dates are frequently included, above or sometimes below the time digits. In virtually all cases, the time and calendar values occupy substantially the entire background or field containing such information.

There are other kinds of prior art digital time displays characterized as quadribalanced, enhanced quadribalanced and unidirectional segmented displays, as disclosed, for example, in U.S. Pat. No. 4,271,497, U.S. Pat. No. 6,214,736 and U.S. Pat. No. 6,584,041, the disclosures of which are incorporated by reference herein. In those displays, the time digits are not confined to a single horizontal array. Instead, the hour digit is positioned in the center of the display field, the minute digits move in right side up/down and left side down/up positions, generally in quarter hour segments, and the seconds digits are located below the hour digit, while incrementing and decrementing during the first and second half hours. As a result, these unconventional displays are presented in relatively larger display fields, much of which do not contain time information during any given quarter hour.

Due to the foregoing, there is a noticeable contrast between the appearances of the two types of displays. In addition, there is no analogous form of time presentation in the latter type compared to the conventional displays, with which consumers have become accustomed to viewing time digits that remain in non-mobile, stationary positions during each hour.

The above-mentioned contrasting visual appearances and the absence of a stationary style of time presentation render the unconventional prior art displays less efficient and versatile than would be attainable if such deficiencies were avoided.

SUMMARY OF THE INVENTION

The present invention overcomes the above-discussed problems by using an expanded display field within which a unified stationary type of time presentation is provided having a strong resemblance to the appearance of the latter mobile type displays characteristic of quadribalanced, enhanced quadribalanced and unidirectional segmented timekeeping sequences. More particularly, the expanded display fields of the invention preferably have substantially the same size and shape as the prior art mobile displays, and the unified stationary time presentations provided within such expanded fields preferably also have substantially the same layout of hour, minutes and seconds digits as that of the mobile displays when the latter are tracking time, for example, during the first quarter hour. In this way, the expanded field and the time presentation of the invention can be incorporated, as such, not only in single acting timepieces, but also in combination with one or more of the mobile time displays, thereby achieving unique advantages of flexibility, versatility and comprehensiveness in tracking the time during general purpose timekeeping.

Other features and details of the invention will be understood from the ensuing specific description read in connection with the drawings.

Figure 1:
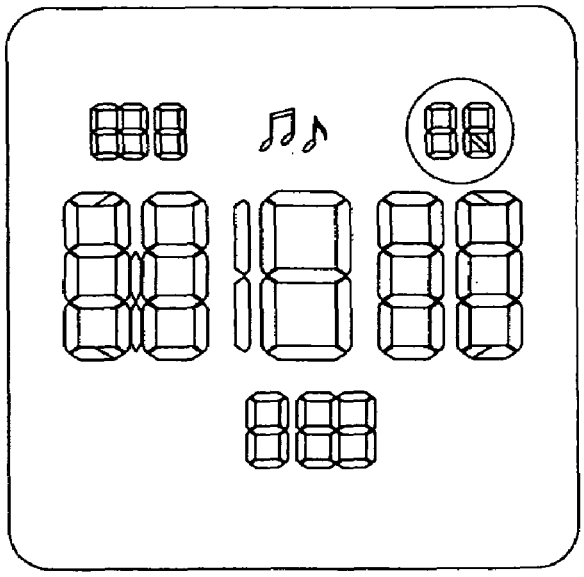
FIG. 1 is a front view of a layout of digital display elements.

Referring to FIG. 1, it illustrates a layout of digital display elements that is substantially like the designs disclosed in the previously cited patents directed to quadribalanced, enhanced quadribalanced and unidirectional segmented displays. Briefly, the top row of elements in FIG. 1 comprise a pattern of three figure 8 elements in the upper left corner for displaying two-letter abbreviations of the seven day names. Next is a three note melody icon which functions as a reminder of an alarm time wake-up call or other set time, as described in copending application Ser. No. 10/765,485, entitled "Ergonomic Watch Case, Time Display and Setting Crown", and Ser. No. 10/948,398, entitled "Enhanced Control Buttons for Digital Timepieces", the disclosures of which are incorporated by reference herein. Lastly, the double figure 8 pattern of display elements circled in the upper right corner of FIG. 1 is normally used for displaying day dates and for setting month, day and year dates when the display is in a real time setting mode, as described in the previously cited patents.

The central row in FIG. 1 comprises double 10-element ladder arrays of display elements flanking both sides of a relatively larger pattern of elements configured as a 10 in the center. These ladder arrays normally display elapsed and remaining minutes relative to the centrally displayed hour digits 1 to 12.

Finally, the lowest group of elements in FIG. 1 comprises three figure 8 patterns which normally display incrementing and decrementing seconds during real time and AM/PM when the mobile displays of the cited prior patents are in setting modes.

Figure 2:
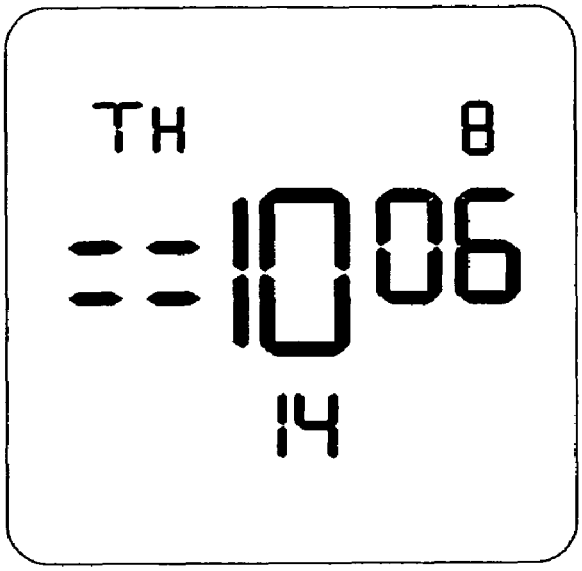
FIG. 2 is a view of a specific time, day name and day date generated by activation of selected elements of the FIG. 1 layout.

Referring to FIG. 2, it displays across the top "TH" comprising an abbreviation for Thursday and "8" as the date for that day. The central row displays, on the left, a pair of double dashes, arranged as two horizontally aligned equal signs, and formed by activation of the four interior horizontal elements of the corresponding 10-element ladder arrays. The equal signs are flanked on the right by a display of hour 10 and elapsed minutes 06, plus 14 elapsed seconds below the hour. This display is preferably programmed to continue to show elapsed minutes and seconds past hour 10 until the end of that hour, and likewise for all the rest of the time during every twelve hour cycle.

Thus, the elapsed time display in FIG. 2 occupies a substantially similar sized and shaped display field, as well as a substantially similar occupied portion of such field, as those of the cited mobile displays of the issued patents. In this way the displays of this invention are unified with and similar to the prior mobile displays. FIG. 2 also marks the unoccupied left side of the central row of the field with the double dashes which are different in appearance from the hash marks used in the cited prior patents. Therefore, this difference serves as a distinguishing feature of the elapsed time display of FIG. 2, in comparison to the time sequences of quadribalanced, enhanced quadribalanced and unidirectional segmented displays that are described in the cited patents.

In this connection, it should be kept in mind that, aside from the double dash markers in FIG. 2, the time display itself, which is representative of the first 15 minutes, is not materially different from the first 15 minutes of the mobile displays of the cited patents. Therefore, if the display of FIG. 2 is incorporated in a timepiece which also includes one or more of the identical 15 minutes of the previous mobile displays, there is a risk of confusion if a user switches from one type of display to the other during such first 15 minutes, or even afterwards. The present invention avoids such confusion by providing special prompts which serve as identifications of the respective displays whenever the displays are switched from one type to one or more of the others.

Figure 3:
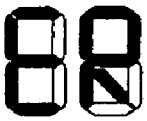
FIGS. 3-5 are views of certain prompts again generated by activation of selected elements of FIG. 1.
Figure 4:
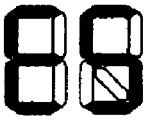
Figure 5:
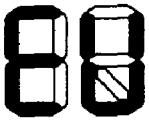

More particularly, the invention generates such prompts by programming selective activations of the circled double 8 date display elements in FIG. 1 to form indicia comprising "ER" in FIG. 3, "ES" in FIG. 4 and "EU" in FIG. 5. The ER prompt identifies the elapsed remaining time sequences of quadribalanced and enhanced quadribalanced time displays. The ES prompt identifies the time sequences of unidirectional segmented time displays, and the EU prompt identifies unified time sequences exemplified in FIG. 2.

Thus, the unified elapsed time sequences exemplified in FIG. 2 can be and preferably are generated as a selectable alternative to one or more of the prior mobile displays of the cited patents. Most preferably, the unified sequence of the present invention is generated in a timepiece that also includes the quadribalanced or enhanced quadribalanced sequence and the unidirectional segmented sequence of the cited patents. It is also most preferred that the availability of such alternative sequences be organized in an order of presentation that initially presents to the viewer a quadribalanced or enhanced quadribalanced sequence as the default display, followed by the prior unidirectional segmented sequence, and thereafter the FIG. 2 sequence of this invention, as a timepiece containing such sequences is switched through such alternatives. In this way, the elapsed remaining time sequences of U.S. Pat. No. 4,271,497 and U.S. Pat. No. 6,215,736, and the mobile unidirectional segmented and elapsed sequence of U.S. Pat. No. 6,584,041, are complemented and capped by the new unified time display of this invention exemplified in FIG. 2.

As one example of the versatility and advantage of the present invention, assume that a viewer is wearing a wrist watch that is displaying 21 minutes until next hour 10 and he or she is rushing to board a train scheduled to depart at 9:52. It may be difficult for some to mentally convert the remaining time of 21 to 10 to 9:39 and then subtract the latter from 9:52 to determine that 13 minutes remain before the train's departure. But, if the viewer's watch permits switching the display to the unified time of 9:39 displayed by the FIG. 2 type of sequence, the difficult mental conversion is avoided and performing the easier subtraction of 39 from 52 to arrive at 13 remaining minutes is facilitated.

The invention has now been described in general principles and specific embodiments. The double 10-element ladder arrays of FIG. 1 flanking the left side of the central hour elements can be selectively activated to generate other patterns of markers than the double dashes of FIG. 2. Therefore, any distinguishing pattern can be substituted for the double dashes. Preferably, all such markers should differ from the hash marks of the cited mobile patents for additional differentiation.

The invention may be practiced with various forms of digital display elements, e.g. LCD, LED, fluorescent, incandescent, gaseous glow or plasma discharges, or dot matrices that can be selectively activated, electronically or electrically, to display the time values and sequences described above.

Many variants of the principles and embodiments of the invention will be obvious to those skilled in the art. Therefore, it should be understood that the ensuing claims are intended to cover all changes and modifications of the illustrative embodiments which fall within the literal scope of the claims and all equivalents thereof.

The invention claimed is:

1. A unified digital time display configured for compatibility with prior quadribalanced, enhanced quadribalanced or unidirectional segmented time displays comprising:

(a) a time display field, (b) display elements positioned generally in the center of the display field and activated to display current digital hours from 1 through 12, (c) display elements positioned in a space beside the right flank of the hour elements and activated to display elapsed minutes from zero to 59 during each current hour, (d) display elements positioned below the hour elements and activated to display incrementing seconds from zero to 59 during each elapsed minute, and (e) display elements positioned in a space beside the left flank of the hour elements and activated to form at least one steady dash that denotes the absence of time information therein as zero to 59 elapsed minutes are displayed on the right flank of each hour, said displays of hours, minutes, and seconds and said dash being maintained in stationary positions throughout such hour, whereby the unified time display claimed herein at least in part will be recognized as similar to and therefore compatible with the prior time displays.

2. A time display according to claim 1 wherein said dash comprises a plurality of dashes.

3. A time display according to claim 2 wherein said dashes comprise two pairs of double dashes resembling two horizontally aligned equal signs.

4. A time display according to claim 3 wherein said equal signs are horizontally aligned toward generally the centers of the hour digits displayed by the hour elements.

5. A time display according to claim 1 wherein the hour, minutes and seconds digits arc graduated in overall size such that the hour digits are die largest, the minute digits are smaller and the seconds digits are smallest in overall size.

6. A time display according to claim 1 which includes (f) display elements positioned above the minute elements in the display field, said elements being activated to display an EU prompt to denote that the field will display unified elapsed time throughout each hour.

7. A time display according to claim 6 wherein the (f) elements are activated to also display an ER or ES prompt to denote that the field will display elapsed remaining or elapsed segmented time, respectively, during each hour.

8. A time display according to claim 7 incorporated in a timepiece which provides alternate switching between the herein claimed unified display and at least one of the prior quadribalanced, enhanced quadribalanced or unidirectional segmented time displays.

9. A time display according to claim 8 incorporated in a timepiece which provides alternate switching between the herein claimed unified display and at least one of the prior enhanced quadribalanced or unidirectional segmented time displays.

10. A time display according to claim 9 wherein the timepiece provides alternate switching from the enhanced quadribalanced time display to the unidirectional segmented display, followed by the herein claimed unified display and thereby establishes presentation of the specified displays in that same order.

11. A time display according to claim 10 wherein each of the respective time displays is preceded by a one second display of only the respective ER, ES and EU prompts formed by correspondingly selected and activated members of the (f) elements.

12. A unified digital time display configured for compatibility with prior quadribalanced, enhanced quadribalanced or unidirectional segmented time displays comprising:

(a) a time display field, (b) display elements positioned generally in the center of the display field and activated to display current digital hours from 1 through 12, (c) display elements positioned in a space beside the right flank of the hour elements and activated to display elapsed minutes from zero to 59 during each current hour, and (d) display elements positioned in a space beside the left flank of the hour elements and activated to form at least one steady dash that denotes the absence of time information therein as zero to 59 elapsed minutes are displayed on the right flank of each hour, said displays of hours and minutes and said dash being maintained in stationary positions, whereby the unified time display claimed herein at least in part will be recognized as similar to and therefore compatible with the prior time displays.

13. A time display according to claim 12 wherein said dash comprises a plurality of dashes.

14. A time display according to claim 13 wherein said dashes comprise two pairs of double dashes resembling two horizontally aligned equal signs.

15. A time display according to claim 14 wherein said equal signs are horizontally aligned toward generally the centers of the hour digits displayed by the hour elements.

16. A time display according to claim 12 wherein the hour and minute digits are graduated in overall size such that the hour digits are the largest and the minute digits are smaller in overall size.

* * * * *